US005544794A

United States Patent [19]

Nichols

[11] Patent Number: 5,544,794

[45] Date of Patent: Aug. 13, 1996

[54] HOLSTER WITH HANGER DEVICE

[75] Inventor: Richard E. D. Nichols, San Diego, Calif.

[73] Assignee: R. E. D. Nichols & Associates, San Diego, Calif.

[21] Appl. No.: 547,689

[22] Filed: Oct. 19, 1995

Related U.S. Application Data

[63] Continuation of Ser. No. 113,052, Aug. 25, 1993, abandoned.

[51] Int. Cl.[6] ..... F41C 33/02

[52] U.S. Cl. ..... 224/667; 224/198; 224/911; 224/912; 224/674; 224/678; 224/677

[58] Field of Search ..... 224/912, 911, 224/252, 253, 192, 193, 198

[56] References Cited

U.S. PATENT DOCUMENTS

| | | | |
|---|---|---|---|
| 769,428 | 9/1904 | Brannon | 224/911 |
| 2,893,615 | 7/1959 | Couper | 224/912 |
| 3,642,183 | 2/1972 | Boren . | |
| 3,902,639 | 9/1975 | Rogers | 224/912 |
| 3,977,583 | 8/1976 | Bianchi et al. . | |
| 4,022,361 | 5/1977 | Devlin | 224/911 |
| 4,079,870 | 3/1978 | Clark . | |
| 4,205,768 | 6/1980 | Hill et al. | 224/193 |
| 4,298,150 | 11/1981 | Seldeen | 224/912 |
| 4,303,185 | 12/1981 | Shoemaker | 224/193 |
| 4,694,980 | 9/1987 | Rogers | 224/243 |
| 4,759,482 | 7/1988 | Olsen | 224/912 |
| 4,809,895 | 3/1989 | Peltier | 224/253 |
| 4,846,383 | 7/1989 | Gallagher | 224/911 |
| 4,925,075 | 5/1990 | Rogers | 224/244 |
| 5,282,559 | 2/1994 | Wisser et al. | 224/911 |

*Primary Examiner*—Linda J. Sholl

*Attorney, Agent, or Firm*—Brown, Martin, Haller & McClain

[57] ABSTRACT

A hanger device for suspending a holster from a wearer's waistband, belt, shoulder harness or the like has a first end part adapted to engage a wearer's waistband, belt or a shoulder harness encircling the wearer's shoulders, and a second end part spaced from the first part for engaging at least one end wall of the holster. A releasable or permanent fastener device secures the second end part to the holster end wall. A substantially rigid connecting member extends between the first and second end parts of the securing device.

29 Claims, 5 Drawing Sheets

HOLSTER WITH HANGER DEVICE

This is a continuation of application Ser. No. 08/113,052, filed Aug. 25, 1993 now abandoned.

BACKGROUND OF THE INVENTION

The present invention relates generally to holsters for handguns, and is particularly concerned with a hanger device for such holsters for suspending the holster from the waist, hip or shoulder of a wearer.

Holsters are commonly provided with some form of hanger device for suspending the holster from a belt or waistband, or from a shoulder harness. During the past two decades, a need has been recognized for a method of suspending a holster that enables the wearer to close his or her jacket while the holstered handgun remains exposed for easy drawing. This is particularly critical in the law enforcement field, where officers must have ready access to their handgun at all times.

One solution which has been adopted is the low-mounted hanger. This type of hanger is made by folding an elongated piece of flexible material, such as leather, and stitching or otherwise fastening the free ends together to form a loop or tunnel to receive the wearer's waist belt. The free ends are then attached to the back or inner side wall of the holster using stitching, rivets or screws. Such low-mounting of the hanger provides a gap or slot between the tunnel-end of the hanger and the back of the holster. A portion of the wearer's jacket can be inserted into this gap and the jacket can then be closed while leaving the holstered handgun outside the jacket for ready access. This type of hanger is typically reinforced with an internal plate of metal or plastic, as shown, for example, in U.S. Pat. No. 4,079,870 of Clark. The low-mounted hanger has been incorporated into many types of holsters, including those used by participants in competitive-type handgun shooting.

A disadvantage of the low-mounted hanger is that, while the holster and hanger assembly is typically rigid when the holster is new, with extended use the hanger and inner side wall of the holster can become over-stressed and flexible. This is in part because a "wishbone" effect is created, in which the grip of the handgun represents one free end of the wishbone, and the belt-receiving end of the hanger represents the other free end. As the result of the leverage created by this effect, the back or inner side wall of the holster, and the hanger itself, can become weakened even during normal use. Severe weakening can occur in the event that an assailant grasps the gun and attempts to remove the gun from the holster by force. Such weakening can reduce the effectiveness of the holster or even make it unserviceable.

Consequently, attempts have been made to strengthen the holster and hanger assembly in order to counter the wishbone effect, using strong rivets or screws and sturdy metal plates to supplement or replace the existing fasteners between the hanger and holster inner side wall. Such reinforcing arrangements are described, for example, in U.S. Pat. No. 3,642,183 of Boren and U.S. Pat. No. 3,749,293 of Bianchi. More recently, Peltier, in U.S. Pat. No. 4,809,895, shows a low mounted hanger that increases the wishbone effect. U.S. Pat. Nos. 4,925,075 and 5,018,654 of Rogers describe a hanger assembly in which thick plastic is used in the hanger and holster side wall in place of the metal plates of Bianchi and Boren.

Typical low-mounted hangers have little or no latitude for determining the amount of "twist" of the holstered handgun grip from the body, i.e. the angle at which the free end of the handgun grip is oriented relative to the wearer's body, which determines whether the grip is turned towards or away from the wearer when viewed from above.

Low-mounted hangers typically are limited further by requiring that the holster have an inner or back side wall of a size and shape suited to the attachment of the hanger. This limitation makes these hangers unsuitable for holster designs having a side wall that is limited in size or contour. For example, competition holsters may have "skeletonized" or cut back body shapes for increased drawing speed and reduced weight, making such holsters often unsuitable for attachment of a low-mounted hanger.

The use of a low-mounted hanger also requires some provision to cover any rivets or other hard fastener means used to attach the hanger to the inner side wall of the holster. Typically a lining or other similar covering is used to cover such devices, adding to the complexity and associated cost of the holster.

The low-mounted hanger is often rigidly attached to the holster body, providing no means for adjusting the height at which the holster is suspended to suit individual needs and situations. Some holsters of this type have incorporated adjustment points, but these are typically at the back of the assembly, next to the wearer's body, requiring removal of the holster from the body to provide access to the adjustment points.

Another limitation of the low-mounted hanger mounted on the back or inner side wall of the holster for the holster manufacturer is that the holster body must be made differently for the left-handed and right-handed user. It is an advantage for the manufacturer and resaler if a single holster body is suitable for either a left-handed or right-handed user and can be configured for left- or right-handed use just prior to shipping and delivery. This reduces manufacturing costs and inventory requirements.

Additionally, when trigger-guard gripping devices, internal cylinder recesses, and spring-closed openings are incorporated into a holster having a low-mounted hanger, the forces required for releasing such devices can be remote from the mounting point of such a hanger. The force required to draw the handgun from such devices can cause deformation of the holster side walls, to the detriment of the performance and useful life of the holster. This can lead to uneven, unreliable release of the handgun.

Thus, existing holster and hanger assemblies are subject to a number of disadvantages both in manufacture and use.

SUMMARY OF THE INVENTION

It is an object of the present invention to provide a new and improved hanger device for suspending a handgun holster from the waist, hip, leg or shoulder of a wearer.

According to the present invention, a hanger device is attached to a holster having an inner side wall, an outer side wall spaced from the inner side wall, and at least one end wall joining the side walls to form a cavity for receiving a handgun. The hanger device comprises a first end portion for attaching to a person, a second end portion spaced from the first end portion for engagement with at least a portion of the end wall, and a substantially rigid connecting piece extending between the end portions. The end portions and connecting piece may be integrally formed or may be separate parts which are suitably attached together. A fastener device is provided for fastening the second end of the hanger device to the end wall.

The hanger device may be attached to the end wall of any type of holster. The end wall to which the hanger device is secured may be a rear end wall for receiving the portion of the handgun nearest to the trigger guard, or a front end wall for receiving the portion of the handgun including the sights. The holster may include one or both end walls. The or each end wall may be formed integrally with the side walls or may be a separate piece, such as a spine used to connect the holster side walls along at least part of their length. The inner or back side wall of the holster is the holster side wall nearest to the wearer's body when the holster is worn, while the outer or front side wall of the holster is the side wall furthest from the wearer. Commonly holsters have all four walls, and in some cases either the forward or rearward end wall has a slit or other opening to permit withdrawal of the handgun through the opening. Some holsters are made with one or more of the four walls substantially reduced in size, or even eliminated altogether. In the present invention, any combination of side walls may be used as long as there is at least one end wall to which the hanger device may be attached, although in the preferred embodiment the holster has two side walls and at least one end wall.

An opening is provided at a first or handgrip end of the holster for insertion and withdrawal of the handgun, and the opposing or muzzle end of the holster may be open or closed. Optionally, the holster may include a security device or arrangement for retaining the holstered handgun, for example retainer straps, cylinder recesses, thumb-break straps, spring clamps, tension screws, or trigger-guard gripping devices. The forward end wall of the holster may include a device or arrangement for protecting the sights of the handgun, for example as described in my U.S. Pat. No. 5,161,721. The rear end wall may be a separate spine member to which the side walls are secured, as described in my co-pending U.S. patent application Ser. No. 08/009,852 filed Jan. 27, 1993 now abandoned.

The first end portion of the hanger device may be designed to engage the wearer's clothing waistband, a belt or other strap encircling the wearer's body at the waist or hips, for example, or a shoulder harness encircling at least one of the shoulders of a wearer. The second end portion which is spaced from the first end may engage either the forward or rearward end wall of the holster, and the connecting piece is preferably a substantially rigid member joining the first and second ends to form a unitary hanger device.

The first end portion of the hanger device is preferably formed into a "U" cross-section to form a tunnel. The tunnel has a bight or bend and opposite side walls forming the tunnel. The free ends of the side walls may be secured together to form a closed loop to receive a belt passing through the loop. Alternatively, the ends may be left unattached to form a paddle for hooking over a belt or insertion in a clothing waistband, or both.

A section or panel of hook-and-loop type fastener material may be secured inside the tunnel formed by the U-section for releasable engagement with a corresponding patch or section of mating hook-and-loop type fastener material secured to at least one planar surface of the wearer's waistband or belt. This serves to lock the holster into a selected location or angle.

In one embodiment of the invention, one side wall of the tunnel is enlarged to form a paddle for increased stability when worn. The side walls of the hanger tunnel need not be of identical size and shape, and the tunnel need not fully enclose or encircle the belt section.

The second end portion of the hanger is designed for receiving at least a portion of the holster end wall, and may be relatively permanently and rigidly attached to the end wall by adhesive, welding, staking, riveting, sewing or any other suitable fastener means. Alternatively, the second end portion may be attached to the holster end wall by means of releasable fasteners such as threaded screws or bolts, mating screw and nut fasteners, hook and loop fasteners, or a combination of such fasteners, and the fasteners may be adjustable to permit the height and orientation of the holster to be adjusted by the wearer.

In a preferred embodiment of the invention, the first and second end portions and the connecting piece extending between the end portions are formed from a single sheet of material such as metal or plastic. In alternative embodiments, the hanger device may be formed in two separate pieces where one of the two end portions is integral with the connecting piece, or in three separate parts where the two end parts and connecting piece are all separate pieces. The two or three separate pieces may be connected together either permanently or releasably to form the hanger device, and a pivotal connection may be provided between two of the pieces to allow for angular adjustment of the holster orientation.

Any or all of the elements of the hanger device may be formed from materials such as thermoplastic resin, sheet or wire metal stock, thermoset plastics, ceramics, composites, or any other substantially rigid material, or combinations thereof. Leather or similar flexible materials may be used to form the tunnel shape at the first end portion of the hanger, and may also be used to cover some or all of the rigid elements or portions thereof. Any plastic parts employed may be shaped by thermo-forming, injection molding, compression molding, extrusion molding, or by any other suitable process or combination thereof.

In a preferred embodiment of the invention, the hanger device is made by blanking a single piece from a sheet of acrylic/polyvinyl chloride, modified polyphenylene oxide, polycarbonate, or similar amorphous plastic resins. The blanked piece is subsequently formed to shape the end parts and connecting piece, using thermo-forming, which is a relatively simple method having low tooling requirements. In another embodiment, a plate made from such metals as steel, brass or aluminum is used to form the hanger device, and may be covered by leather or similar flexible materials. The plate is then formed into the appropriate shape by bending to form the first and second end parts and connecting piece.

In one embodiment of the invention the second end part of the hanger device is releasably secured to the holster end wall. In this embodiment, the second end part of the hanger and holster end wall are each provided with one or more aligned openings, and the fastener device comprises at least one externally threaded fastener which is passed through one pair of aligned openings in the end wall and second end part of the hanger, and a nut for releasably engaging the end of the fastener. The nut is tightened to clamp the hanger device to the holster body. One or both of each pair of aligned openings may comprise a slot to allow for some adjustment of the point of attachment of the hanger, and thus the distance of the holster body from the first part of the hanger device. The dimensions of the slots or openings may be such as to allow only vertical adjustment or so as to allow for some degree of rotational or lateral adjustment. The nut will be readily accessible for loosening and adjusting the fastener, even while the holster is being worn.

The second end part of the hanger device preferably comprises a wall member and may be of any cross-section for matching and fitting against the end wall of the holster, such as arcuate, flat, straight, compound curve, or any combination thereof. Where the holster receiving wall member or end part of the hanger is of concave cross-section for receiving a corresponding convex cross-section of the holster end wall, for example, it will contribute to the alignment and structural rigidity of the attachment of the hanger to the holster end wall.

The hanger device may be attached only to the end wall of the holster in some embodiments of the invention. However, in embodiments where additional rigidity is required, such as security holsters for law enforcement officers, the hanger device may additionally be attached to the inner side wall or back wall of the holster. In this embodiment, the connecting piece is configured to overlie at least a portion of the inner side wall of the holster, and is attached to the side wall portion by means of any suitable permanent or releasable fastener. This provides increased strength and increased resistance to over-flexing or fracture of the holster at the point of attachment to a hanger device.

The first end portion of the holster may be configured to accommodate a belt or waistband, or may be connected to a shoulder harness for suspending the holster body at or under the wearer's shoulder area. The first part may also be attached relatively permanently to the belt by means of rivets, screws, stitching or similar means of attachment.

The hanger device attached to an end wall of a holster body avoids many of the problems of previous hanger devices. The size and shape of the holster body becomes less critical because the hanger does not necessarily attach to a holster side wall, allowing the hanger device to be used readily with a "skeletonized" competition-style holster. The hanger device also provides ambidextrous mounting capability for a single holster body, because the hanger does not have to be attached to one or the other holster side wall. Thus, right- and left-handed hanger devices can be provided for attachment to the same holster body for right- and left-handed users. This enables reduction of assembly complexity and reduced inventories at all levels of distribution.

Preferably, the end wall of the holster to which the hanger device is attached comprises a rigid spine, which provides a rigid mounting surface and allows the side walls to be made of different, relatively soft materials. The hanger device of this invention is less sensitive to the contours of the holster side walls and to the location of any fasteners in the side walls. The hanger device is equally well suited to attachment to the forward or rearward end wall of the holster, and may even be attached to both in some applications.

BRIEF DESCRIPTION OF THE DRAWINGS

The invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
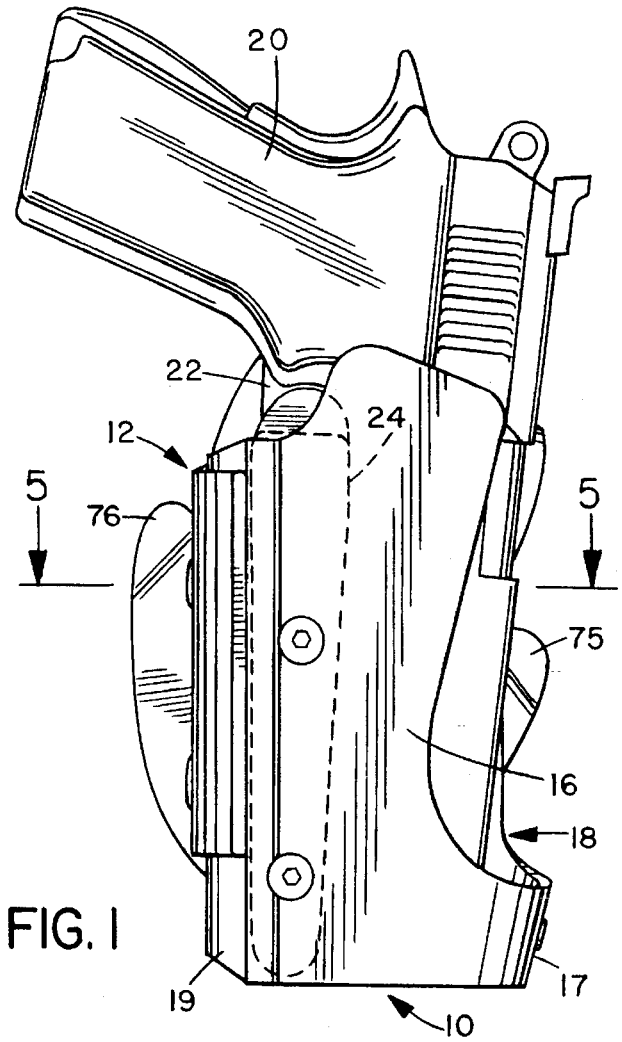
FIG. 1 is a side elevation view of the front of a holster body with a hanger device according to a first embodiment of the invention secured to the holster body and a handgun inserted in the holster.
Figure 2:
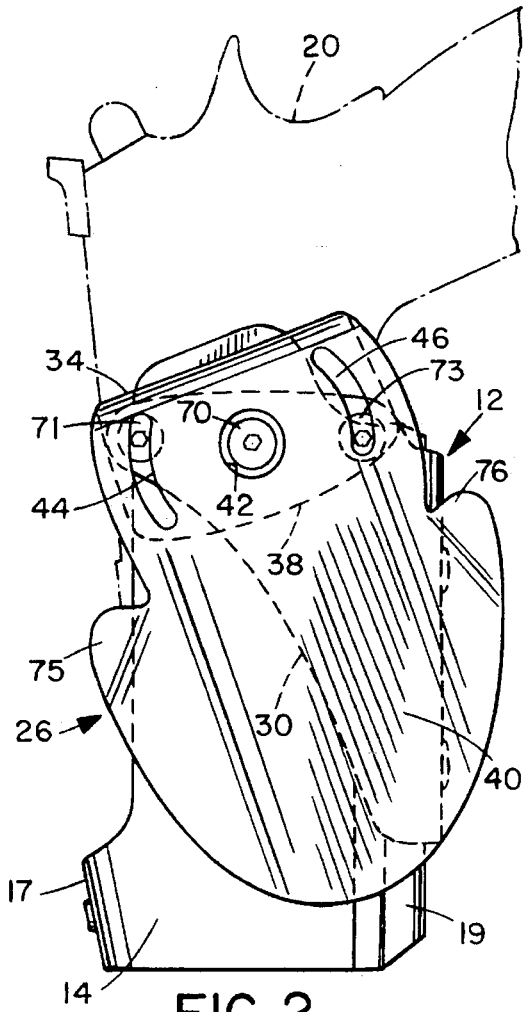
FIG. 2 is a side elevation view of the back or inner side face of the holster body and hanger device of FIG. 1.
Figure 3:
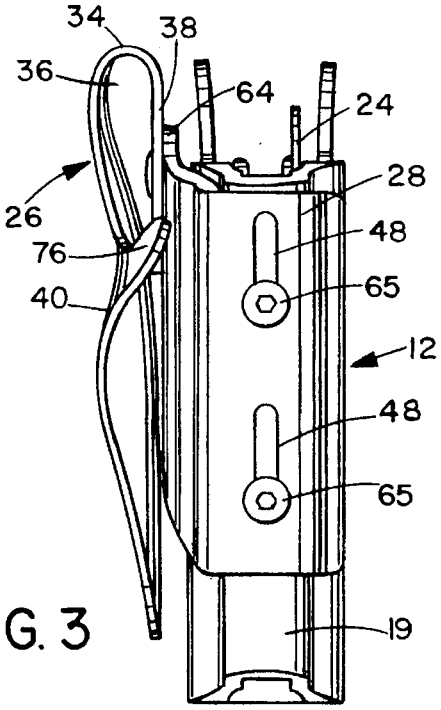
FIG. 3 is a rear elevation view of the holster body of FIG. 1 illustrating the attachment mechanism of the hanger device.

FIGS. 1–3 of the drawings illustrate a holster body 10 and a hanger device 12 according to a first embodiment of the present invention for suspending the holster body from a wearer's belt, waistband, shoulder harness or the like. The holster body 10 has an inner side wall 14 which is against the wearer's body when the holster is worn, an outer side wall 16 spaced from the inner side wall, a front end wall 17 which is cut away to leave an opening 18, and an elongate, rigid spine member 19 at the rear end of the holster which secures the two side walls together at the rear of the holster. The spine member 19 is preferably as described in my copending application Ser. No. 08/009,852 filed Jan. 27, 1993 now abandoned, the contents of which are incorporated herein by reference. The side walls, front end wall and rear end spine together form a cavity for receiving a handgun 20 inserted in the holster as illustrated in FIGS. 1 and 2. The trigger guard 22 faces the rear end spine and the front sights face the front end wall 17 and opening 18. This holster is of the quick-draw, competition type.

A trigger guard locking device 24 is secured to the spine 19 at the rear end of the handgun receiving cavity, and serves to lock the trigger guard in the illustrated position unless released by pushing down on the handgun and pivoting forwardly through the opening 18. The locking device 24 is preferably as described in my co-pending application Ser. No. 07/771,206 filed Oct. 4, 1991 now U.S. Pat. No. 5,284,281, the contents of which are incorporated herein by reference, although any suitable handgun locking device may be used in place of device 24.

Figure 4:
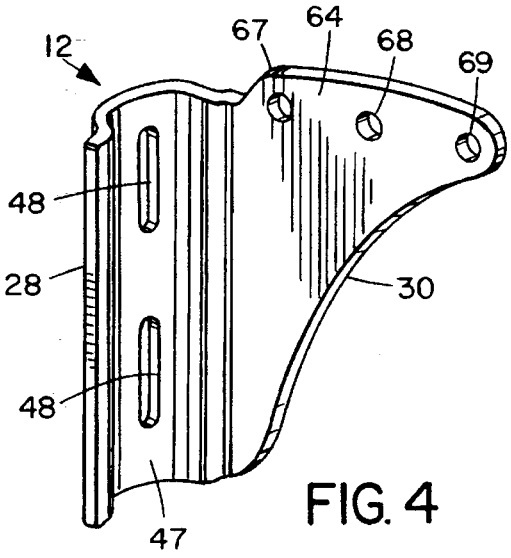
FIG. 4 is a perspective view of part of the hanger device of FIGS. 1–3.

The hanger device 12 basically comprises a first end part or portion 26 designed for attaching to the holster wearer, a second end part or portion 28 for attaching to an end wall of the holster, and a connecting portion 30 extending between the first and second end portions. In this embodiment, the second end portion 28 and connecting portion 30 are made from a single piece of material, as illustrated in FIG. 4, while portion 28 is made separately. However, portions 28 and 30 may also be made separately in alternative embodiments, or all three portions may be formed integrally.

The first end portion 26 comprises a plate of a suitable rigid plastic or leather which is folded about bight or fold region 34 to form a U-shaped channel or tunnel 36 having spaced side legs 38,40. One of the legs 40 is larger than the other and is shaped to form a paddle for hooking or inserting inside a wearer's belt or waistband with the other leg 38 on the outside of the waistband. The paddle is preferably of the shape described in my co-pending application Ser. No. 07/749,992 filed on Aug. 26, 1991 now U.S. Pat. No. 5,265,781, the contents of which are incorporated herein by reference. Thus, the paddle 40 has an opening 42 and a pair of arcuate slots 44,46, one on each side of opening 42, and the opening 42 and slots 44,46 are aligned with corresponding opening and slots in the underlying leg 38, which are not visible in the drawings, and are described in my application Ser. No. 07/749,992 now U.S. Pat. No. 5,265,781.

Figure 5:
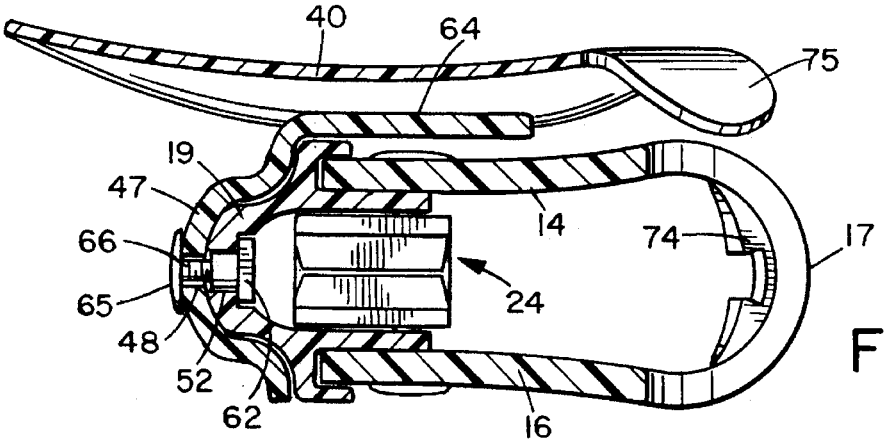
FIG. 5 is a section on the lines 5—5 of FIG. 1.

The second end portion 28 of the hanger device is a wall or channel member 47 of slightly curved cross-section matching that of the spine 19 and designed to fit over and conform to part of the outer surface of the spine, as best illustrated in FIG. 5. The wall member has a pair of aligned, vertically oriented slots 48 positioned on the central axis of the wall member, and the spine 19 has a pair of holes 52 which are aligned with the slots 48 when the wall member is placed over the spine 19 in the appropriate position. A pair of releasable fastener devices extend transversely through the respective pairs of aligned slots and holes 48 and 52, as illustrated in FIG. 5. Each fastener device comprises a female fastener or nut 62 having a threaded bore and a male fastener or bolt 65 having a correspondingly threaded shaft 66 for releasable threaded engagement in the bore of nut 62. This arrangement allows the position of wall member or portion 28 on the spine to be adjusted up or down, thus adjusting the level of the holster body relative to the attachment position on the body of the wearer. It will be understood that only one slot may be used, or each slot may be provided on the spine rather than the hanger. Alternatively, slots may be provided on both spine and hanger. If no adjustment is desired, aligned holes may be provided on both the spine and the hanger.

The connecting portion 30 comprises a flange or panel 64 projecting from one side of wall member 28 at an appropriate angle for extending across the inner side wall of the holster when the wall member 28 is secured to the end wall or spine 19, as best illustrated in FIGS. 4 and 5. Thus, panel 65 projects approximately perpendicular to the channel 28. The connecting portion 30 has a line of three openings or holes 67,68,69 for receiving a suitable fastener for securing the connecting portion 30 to hanger end portion 26. The central hole 68 is placed in alignment with the central hole in the leg 38 of the hanger end part or portion 26, and a pivot pin 70 is inserted through the aligned openings (see FIG. 2). A pair of screws, bolts or other releasable fasteners 71,73 extend through the side holes 67,69 and respective aligned arcuate slots in leg 38 for engagement with nuts (not illustrated). This arrangement allows the part 26 to be pivoted relative to the connecting portion 30 so that the paddle 40 can be oriented at any desired angle to an attached holster body, and then locked in a selected orientation. The fasteners 71,73 travel along the respective arcuate slots as the part 26 is rotated, and are then locked in position via lock nuts when the desired orientation is reached. As illustrated in FIGS. 1 and 3, the second part 28 of the hanger device which is secured to the rear end wall of the holster has a length in a direction parallel to the longitudinal axis of the holster which is greater than half the length of the holster rear end wall.

A sight protection strip 74 of the type described in my U.S. Pat. No. 5,161,721 may be secured in the front end wall 17 of the holster, as illustrated in FIG. 5, for protecting the front sight of a holstered handgun.

It will be understood that the hanger device 12 described above may be secured to other styles of holster body in place of holster 10. All that is required is for at least one hole to be drilled in an end wall of any holster body, and the hanger device can then be secured to the end wall in the same way that it is secured to the spine 19 in the embodiment described above.

The paddle 40 can be inserted inside any waistband or belt and has a pair of barbs or prongs 75,76 for engaging the lower edge of a wearer's belt or waistband to retain the holster in the desired position. The height of the holster body relative to the waistband can easily be adjusted even while wearing the holster, simply by loosening bolts 65 and moving the holster body up or down relative to the hanger device via slots 48 until a desired position is reached, at which point the bolts 65 are re-tightened.

The integrally formed end portion 28 and connecting portion 30 may be made from any suitable, relatively rigid material, such as metal, metal covered with leather or plastic, leather, or plastic. Preferably, however, this part of the hanger device is made by thermo-forming a suitably shaped blank of substantially rigid plastic material such as acrylic/polyvinyl chloride, modified polyphenylene oxide, polycarbonate or the like.

By providing a hanger device which is mounted only on the holster end wall which is a rigid spine, as in the above embodiment, the material of the holster body becomes less critical in providing a secure mount to the wearer's body. Because the hanger device does not have to be attached to a holster side wall, the remainder of the holster body apart from the rigid spine may be made of a relatively soft, protective material.

Another advantage with this arrangement is that the size and shape of the holster body becomes less critical. The holster body may even be "skeletonized" or cut down to a mere skeleton or open framework, because the hanger does not rely on attachment to a holster side wall.

This arrangement also provides ambidextrous mounting capability for a single holster, avoiding the need to make two different holsters, one for right-handed and one for left-handed users, since the hanger device does not have to be attached to one or the other side wall. The construction of the holster itself is also simplified with this arrangement, since the holster need not be laminated to cover fasteners on the holster side wall.

Figure 6:
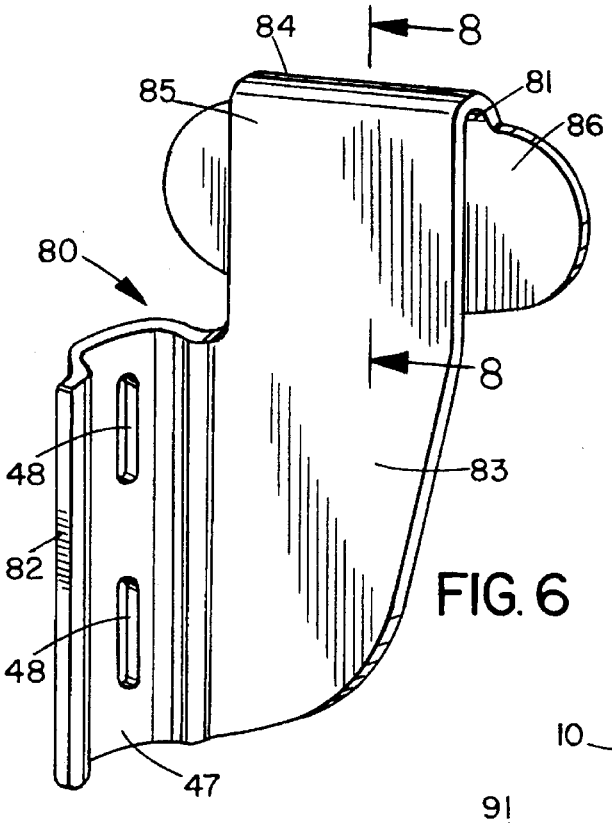
FIG. 6 is a perspective view of a hanger device according to a second embodiment of the invention.
Figure 7:
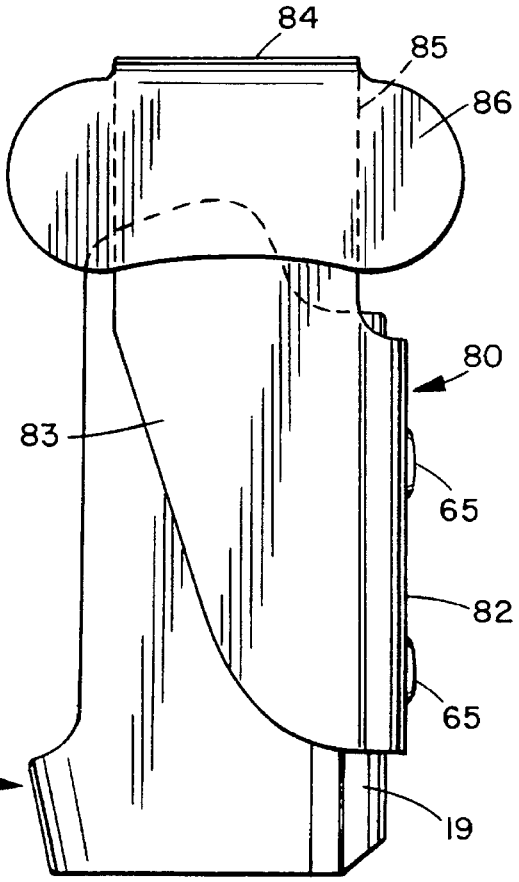
FIG. 7 is a side elevation view of the hanger device attached to a holster.
Figure 8:
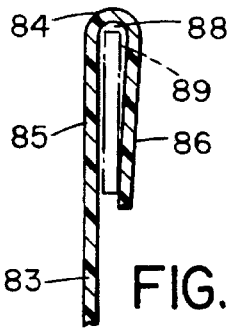
FIG. 8 is a cross-sectional view of a first end of the hanger device mounted on a belt.

FIGS. 6–8 illustrate a modified hanger device 80 which may be secured to any type of holster body, such as the holster body 10 of FIGS. 1–5 in a similar manner to hanger device 12 of the previous embodiment. In this embodiment, the hanger device 80 is formed from a single piece of material and has first and second end portions 81,82 and connecting portion 83 of relatively rigid material extending between the end portions. The second end portion 82 for securing to a holster end wall is similar to the second end portion 28 of the previous embodiment, and like reference numerals have been used for like parts as appropriate. Thus, as in the previous embodiment, end portion 81 is of channel shape 47 designed to fit over part of a holster end wall, and has a pair of aligned, linear slots 48 for alignment with corresponding holes in the holster end wall. As in the previous embodiment, the length of the second end portion 82 is greater than half the length of the holster end wall in a direction parallel to the longitudinal axis of the holster, as illustrated in FIG. 7.

The first end portion 81 is generally U-shaped having a fold or bight 84 and opposite side legs 85,86 forming a channel or tunnel 88 for hooking over a waistband or belt. Outer side leg 86 is of generally oval, elongated shape to form an enlarged area for resisting tilting or wobbling of an attached holster. Connecting portion 83 comprises a generally flat panel extending to one side of the channel 36 and upwardly into the inner side leg 85 of the U-shaped channel. The entire hanger device 80 can be suitably formed by blanking out an appropriate shape from a single piece of material and then thermo-forming and bending it into the shape illustrated in FIG. 6. The second end portion 82 can then be attached to a holster end wall using appropriate releasable fasteners 62,65 as in the previous embodiment.

The hanger device 80 can be hooked over a waistband or belt 89 as illustrated in FIG. 8 with the enlarged inner leg or paddle 86 inside the belt 89 and bearing against the inner face of the belt to resist dislodging of the holster and hanger device. The holster will then be suspended from the belt, and the height of the holster can be easily adjusted simply by releasing the fasteners 65 and moving the holster up or down as the fasteners travel along slots 48 until the desired height is reached, which will be a matter of personal preference. The fasteners can then be re-tightened to hold the holster at the desired position below the belt.

Figure 9:
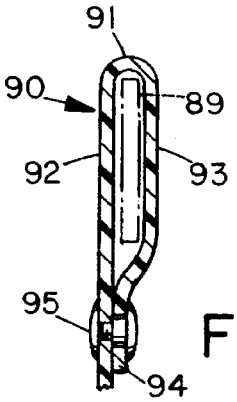
FIG. 9 is a cross-sectional view of a modified belt-mounting end for the hanger device of FIGS. 6 and 7.

FIG. 9 illustrates a modification of the embodiment of FIGS. 6–8 in which the second end portion 90 of a hanger device which is otherwise identical to that of FIGS. 6–8 is folded or bent along bend or bight 91 to provide opposite side legs 92,93. Legs 92,93 are secured together at the free end 94 of the outermost side leg 93 via rivets or other fasteners 95 to form a closed loop for receiving the belt 89 of a wearer.

Figure 10:
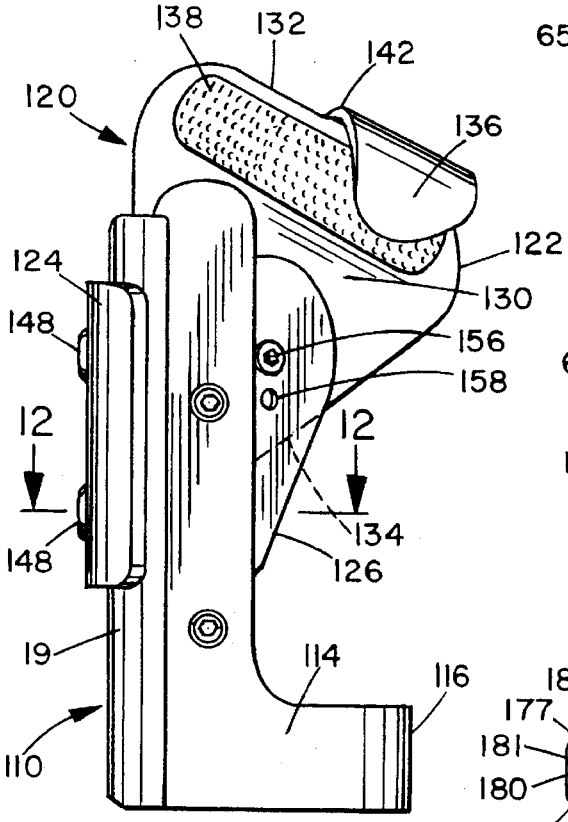
FIG. 10 is a side elevation view of the outer side of a holster with a hanger device according to another embodiment of the invention secured to the holster.
Figure 11:
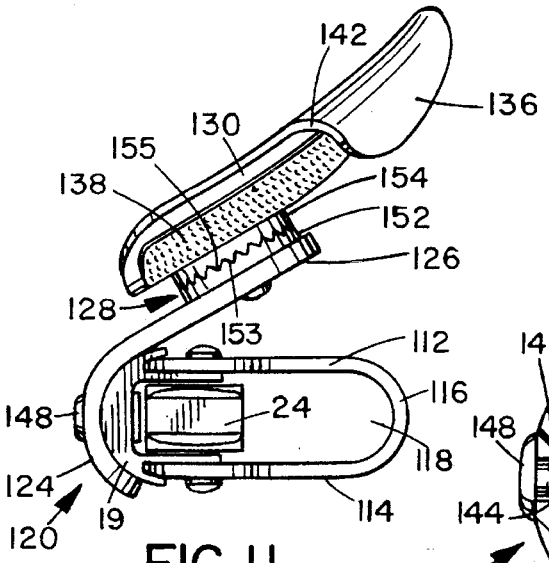
FIG. 11 is a top plan view of the holster and hanger device of FIG. 10.
Figure 12:
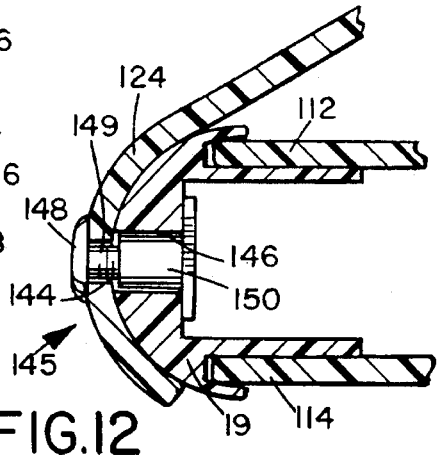
FIG. 12 is a section on the lines 12—12 of FIG. 10.

FIGS. 10–12 illustrate a modified holster and hanger assembly according to another embodiment of the invention. Holster 110 is an open-fronted, competition style holster similar to that of FIGS. 1–3 and has an inner side wall 112, outer side wall 114, front end wall 116 which is cut away to leave an opening 118 for drawing a handgun from the holster, and a rear end wall comprising an elongate, rigid spine member 19 which is identical to the spine member in the first embodiment. Spine member 19 secures the free ends of the two side walls together at the rear of the holster to form a handgun receiving cavity. As in the first embodiment, a trigger guard locking device 24 is secured to the spine at the rear end of the cavity.

The hanger device 120 has a first end portion 122 for attaching to the holster wearer, a second end portion 124 for attaching to an end wall of the holster, and a connecting portion 126 for securing the two end portions together in the correct relative orientation. In this embodiment, the connecting portion 126 and second end portion 124 are formed integrally from a single piece of material while the first end portion 122 is made separately and rotatably secured to the connecting portion via a ratcheting adjustment mechanism 128.

The first end portion 122 comprises a paddle 130 of generally triangular shape having an upper straight edge 132 and a lower apex 134 which is rotatably secured to the connecting portion 126 via adjustment mechanism 128. A relatively small hook-shaped projection 136 is formed on the upper edge 132 for hooking over the top of a belt when paddle 130 is passed behind the belt. A strip 138 of hook-and-loop type fastener material or Velcro® is secured to the inner face of the paddle 13 for engagement with a mating hook and loop type fastener strip which will be secured on the inner surface of the belt which faces the body when worn. The hook-like projection has a bend or bight 142 which will engage the upper edge of the belt to prevent the hanger from being disengaged if the wearer pushes down on a pistol or handgun in the holster.

The second end portion 124 is of arcuate shape matching the curvature of the outer surface of holster spine 19, and has a pair of vertical slots 144 for alignment with corresponding holes 146 in the spine 19, one of which is illustrated in FIG. 12. A screw member 145 with an enlarged head 148 has a threaded stem or shaft 149 which projects through an aligned slot 144 and hole 146, with a similar screw member projecting through the other aligned slot and hole. Each threaded shaft 149 engages a nut 150 with a corresponding threaded bore at the inner face of the spine. This allows vertical or height adjustment as in the first embodiment. The ratchet mechanism 128 allows the angle of the holster to be adjusted in a conventional manner.

As best illustrated in FIG. 11, the connecting portion 126 projects from one side of the arcuate second end portion 124 at an angle to the inner side wall 112 of the holster. With this arrangement, the holster will tilt outwardly from the body of a wearer when the paddle is suspended from a belt via hook 136. This allows access to the head of fastener device 156 while the holster is being worn, so that the angle of the holster can be adjusted if necessary.

This arrangement enables the wearer to attach the hanger device 120 to a belt by inserting paddle 130 under the belt from below until the hook 136 clears the upper edge of the belt, and then pulling down on the hanger until the bend or bight 142 engages the upper edge of the belt with the hook on the outside of the belt. The mating hook-and-loop fastener strips on the hook and the belt temporarily fix the hanger at a desired position on the belt as to angle and location relative to a wearer's waist. The bend or bight 142 therefore normally prevents the hanger from being dislodged if a wearer pulls down on the holster or pistol. Hook-and-loop fastener 138 normally prevents the hanger from being disengaged when the wearer pulls up on the handgun or pistol while drawing the pistol from the holster.

The adjustable sliding engagement between the hanger device and holster end wall in this and the previous embodiments allows easy modification by the wearer of the height of the holster relative to the belt or waistband.

Figure 13:
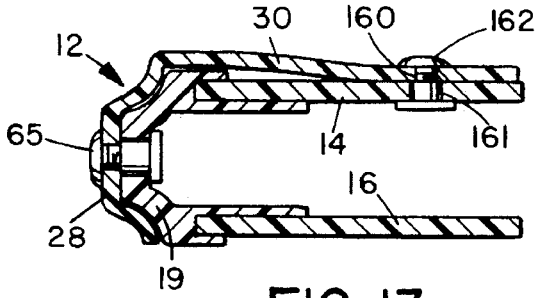
FIGS. 13–15 are sectional views illustrating various alternative second end portion configurations for the hanger device attached to different types of holsters.
Figure 14:
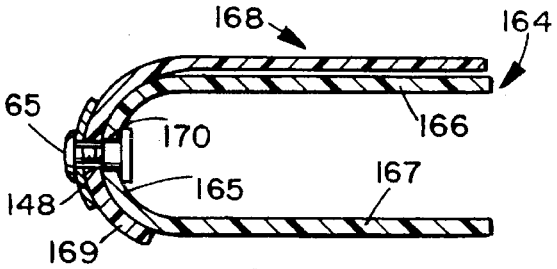
Figure 15:
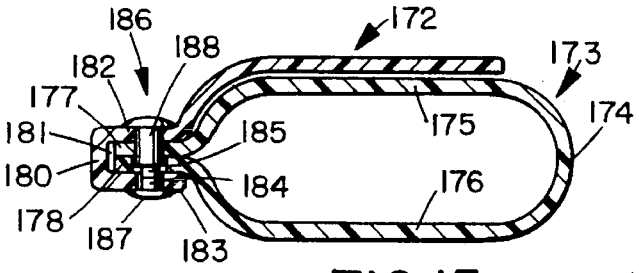

FIGS. 13–15 illustrate some different arrangements for attaching a hanger device to the holster. FIG. 13 is similar to the embodiment of FIGS. 1–5, and like reference numerals have been used where appropriate. However, in this version the hanger device 12 is attached to the inner side wall 14 of the holster as well as to end wall or spine 19. As illustrated in FIG. 13, the connecting portion 30 of hanger device 12 overlying the inner side wall of the holster has an opening 160 aligned with a corresponding opening or hole 161 in the holster inner side wall 14. A releasable fastener device 162 extends through the aligned openings to secure the hanger to the inner side wall 14. It will be understood that other types of fastener devices such as adhesive, stitching, rivets and the like may be used in place of fastener device 162 in alternative embodiments, and that more than one such fastener device may be used.

The arrangement illustrated in FIG. 13 has advantages over a conventional side wall mounted hanger since any forces applied to the holster will be spread over a larger area, reducing the risk of warping and weakening of the holster. However, no vertical adjustment is provided in this arrangement and the fasteners 65 extend through aligned holes in the first end portion 28 and spine 19, rather than a slot and a hole as in the previous embodiments.

FIG. 14 illustrates a modification in which a holster 164 has a rear end wall 165 formed integrally with side walls 166,167. Hanger device 168 may have a first end portion as illustrated in any of the preceding embodiments, and has an arcuate second end portion 169 for engagement over part of the rear end wall 165, which is of similar arcuate cross-section. Second end portion 169 preferably has linear slots 48 as in the first embodiment, while holes 170 are provided in end wall 165 for alignment with the respective slots. Fasteners 65 which are identical to the fasteners in the first embodiment extend through the aligned slots and holes. This version is therefore similar to the first embodiment except that the holster has an integral rear end wall rather than a separate rigid spine. The hanger device itself will reinforce the rear end wall for added strength and stability.

FIG. 15 illustrates another modified hanger device 172 for attachment to a holster 173 of the type formed from a single piece of material which is folded to form a bight 174 at the front end wall of the holster, and opposite side walls 175,176 which are secured together at their free ends 177,178 via any suitable fastener mechanism to form a rear end wall of the holster. In this version, the second end portion 180 of the hanger device is folded or bent over to form a generally square cross-section channel 181 for engagement over the connected rear ends 177,178. Opposite side walls 182,183 of the channel 181 and the rear ends 177,178 of the holster side walls have at least one set of aligned openings 184, 185, respectively, through which a suitable releasable fastener device 186 projects. The openings 184 may be elongated slots to allow for vertical adjustment. The fastener device 186 may comprise a bolt or screw 187 having a threaded shaft for releasable engagement in a threaded bore of female member or nut 188, for example, although other types of fasteners may be used.

Thus, it will be understood that the shape of the second end portion of the hanger device may be modified as necessary to fit closely over the end wall of any holster. Where the end wall is a separate rigid spine, the remainder of the holster can be of a relatively soft material. However, the hanger device is also suitable for attachment to other types of holsters with end walls formed integrally with the side walls or by securing together the free ends of the side walls at one end of the holster, as in FIG. 15. The hanger device can be conveniently made by injection molding, extrusion, thermo-forming and similar techniques.

The adjustment slots in the second end portion of the hanger device need not be vertically oriented, as in the previous embodiments, but may alternatively be horizontal or arcuate to allow different types of adjustment.

Figure 16:
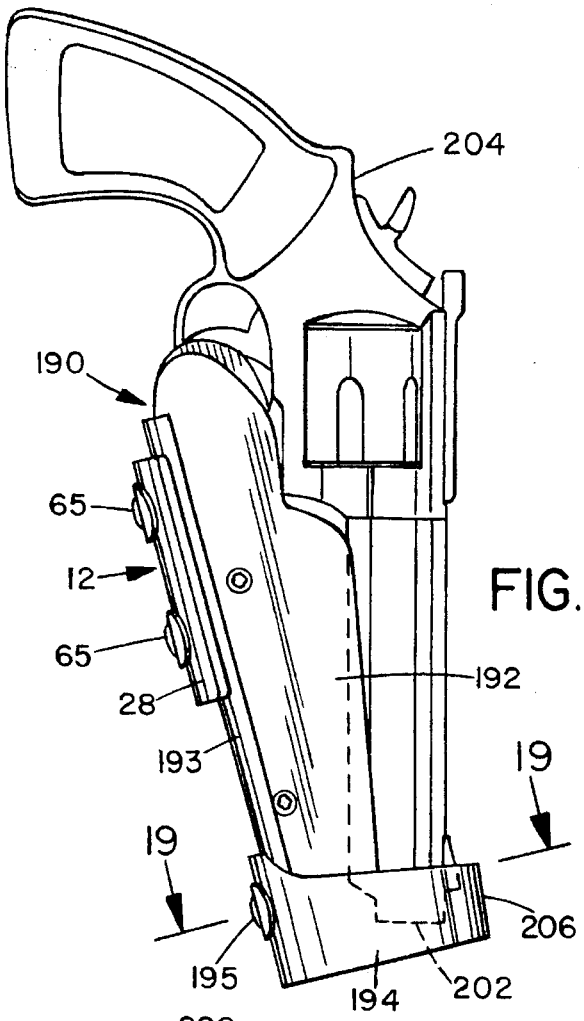
FIG. 16 is a side elevation view of a holster with a hanger device and adjustable muzzle ring according to another embodiment of the invention.
Figure 17:
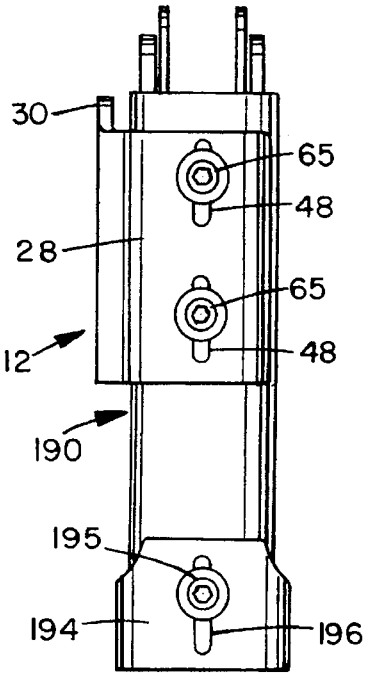
FIG. 17 is a rear end elevation view of the holster of FIG. 16.
Figure 18:
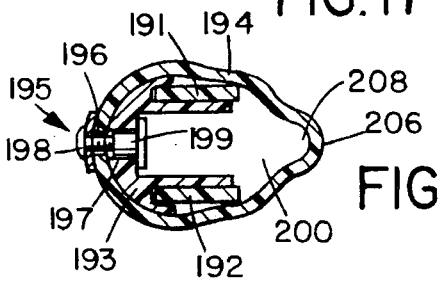
FIG. 18 is a section on the lines 18—18 of FIG. 16.

FIGS. 16–18 illustrate another embodiment of the invention in which a holster 190 has spaced side walls 191,192, a rigid spine 193 securing the side walls together at a rear end of the holster, and a completely open front end. An adjustable muzzle receiving ring or boot 194 is adjustably mounted at a lower end of spine 193 via a releasably fastener 195 which extends through a vertical slot 196 in ring 194 and an aligned opening 197 in spine 193, as best illustrated in FIGS. 17 and 18. Any suitable releasable fastener may be used, for example a screw member 198 which engages a threaded bore in a nut or female member 199 on the inner side of the holster. A hanger device 12 of the type illustrated in FIGS. 1–4 is secured to the upper part of spine 193 in the same manner as described above in connection with the first embodiment, and like reference numerals have been used as appropriate. A suitable trigger guard locking mechanism (not illustrated) may be mounted on the spine at the rear end of the handgun receiving cavity 200 to hold a handgun in the holster until positively released.

Muzzle ring or boot 194 acts to receive the muzzle end 202 of a handgun or pistol 204 when inserted into the holster. The ring 194 can be moved lengthwise along the spine in order to adjust its position to conform to different size handguns, simply by releasing fastener 195 and re-tightening it once the desired position has been reached.

The muzzle ring may be extruded of suitable plastic material or formed by molding from a tubular section. The forward end 206 of the ring 194 is shaped to form a sight groove 208 for receiving the front sight 210 of the pistol. Although the muzzle ring in the illustrated embodiment is attached to a holster spine, it may also be used on conventional holsters having a front or rear fold.

Figure 19:
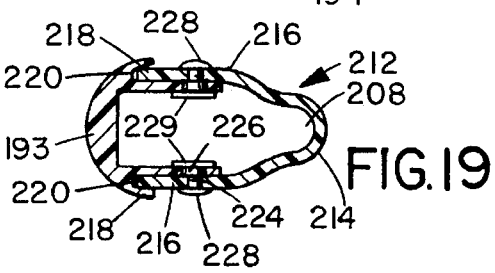
FIGS. 19 and 20 are sectional views similar to FIG. 18 illustrating modified muzzle rings.

A modified muzzle ring 212 is illustrated in FIG. 19. The holster in this version is equivalent to that of FIGS. 16–18, and like reference numerals have been used as appropriate. The muzzle ring 212 has a front fold 214 and opposite side walls 216. The rear ends 218 of the side walls are received in channels or grooves 220 in rigid spine 193 forming the rear end wall of the holster, in a similar manner to the side walls of the holster itself. The side walls 216 of the muzzle ring have vertical slots 224 which are aligned with holes 226 in the underlying portions of the spine 193, and releasable fasteners or adjustment screws 228, which may be of the same type as fastener 195 in the embodiment of FIGS. 16–18, extend through each aligned slot and opening for engagement in a nut 229. This allows the position of the muzzle ring 212 on the spine to be adjusted in an equivalent manner to the previous embodiment.

Figure 20:
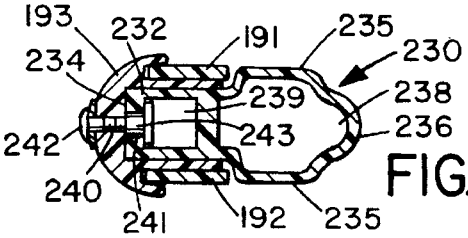

FIG. 20 illustrates another modified muzzle ring 230 which is secured to the inside face of a holster spine 193 rather than to the outside face as in the embodiment of FIGS. 16–18. Muzzle ring or boot 230 has a hollow, rear spacer block 232 for engagement in the central channel or groove 234 of the spine 193, and spaced side walls 235 projecting forwardly from block 232 and joined together at the forward end 236 of the ring to form an enclosed region for receiving the muzzle of a handgun. A sight groove 238 is provided at the forward end 236 of muzzle ring 230. The spacer block 232 has a central bore 239. In this version, a vertical slot 240 is provided in the spine 231 itself rather than the muzzle ring, and an opening 241 is provided in the underlying wall of block 232 in alignment with slot 240. A suitable releasable fastener or adjustment screw device 241 extends through the aligned slot and opening for engagement with nut 243. Instead of providing a slot 240 in the spine 231, slots may alternatively be provided in each of the two side walls 191,192 of the holster with aligned openings in the underlying side walls of the block 232, with corresponding fasteners extending through each aligned slot and opening.

In all of the embodiments of FIGS. 16–20, an additional holster adjustment is provided in the form of a vertically slidable muzzle receiving ring. Thus, the holster itself can be adapted for different size handguns, while the holster position relative to the wearer can also be adjusted. Each adjustment can be made via readily accessible fasteners on a rear end wall of the holster.

Figure 21:
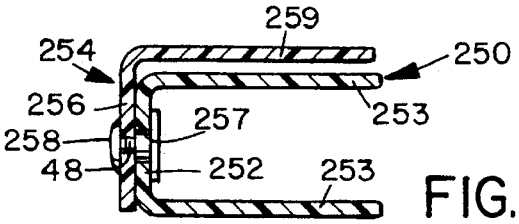
FIG. 21 is a sectional view similar to FIGS. 13–15 illustrating a hanger with another modified second end portion for attachment to a holster with a flat end wall.

FIG. 21 illustrates another modified holster and hanger assembly, in which the holster 250 is of the type having a rear fold 252 and spaced side walls 253 projecting forwardly from the rear fold. The holster may have an open, partially open, or closed front end. As illustrated, the holster rear fold or rear end wall 252 is of square or rectangular cross-section. FIG. 21 illustrates part of a hanger device 254 suitable for attachment to such a holster. The first end portion of the hanger device 254 for attaching the device to a wearer is not illustrated, but may be the same as that of any of the preceding embodiments. The second end portion of the hanger device comprises a flat portion or surface 256 for placing against the outer surface of flat end wall 252 of the holster. The flat portion 256 may have one or more vertical adjustment slots, for example slots 48 and 50 as in the first embodiment, and the end wall 252 is provided with holes 257 in alignment with each slot. Suitable releasable fastener devices 258 of the same type as in the previous embodiments extend through each aligned slot and hole.

Hanger device 254 has a connecting portion 259 which comprises a flat surface or plate extending generally perpendicular to flat surface 256 across the inner side wall of the holster. The first end portion (not illustrated) may be formed integrally with connecting portion 259 or separately therefrom. This hanger device may be secured to any holster having a flat end wall.

Figure 22:
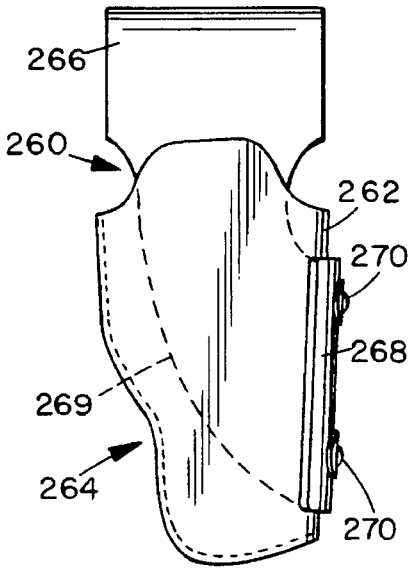
FIG. 22 is a side elevation view of a holster and hanger device according to another embodiment of the invention.

FIG. 22 illustrates a hanger device 260 which is secured to the front end wall 262 of holster 264. Hanger device 260 has a first end portion 266 which comprises a belt loop of the type illustrated in FIG. 9, for example, for suspending the hanger device from a wearer's belt. Alternatively, the first end portion may be the same as any of the other hanger devices described above. The second end portion 268 is of arcuate cross-section for fitting over the front end wall 262 of the holster, in a similar manner to the end portion 169 described above in connection with FIG. 14. However, in this case the connecting portion 269 extends from the opposite side of the channel or groove formed by the end portion 268 so that end portion 268 can be secured to the front end wall rather than the rear end wall of the holster, with the connecting portion extending across the inner side wall of the holster in the opposite direction to the connecting portion of the previous embodiments.

The end portion 268 has vertical slots (not visible in the drawing) which will be identical to the slots 48 described above in connection with FIGS. 1–5 above, and the underlying front end wall has holes (also not visible in the drawing) aligned with the slots. An adjustment screw fastener 270 extends through each slot and aligned hole for engagement in an internally threaded nut. Screw fastener 270 and the corresponding nut will be identical to the adjustable fastener devices of the previous embodiments, such as fastener 65. Thus, the height of the hanger device on the holster front end wall can be adjusted even while the holster is worn, simply by releasing fasteners 270 and sliding up and down along the slots to the desired height. This controls the height of the holster on the wearer's body, and can be adjusted according to personal preference and convenience.

FIGS. 23–26 illustrate a hanger device 280 according to another embodiment of the invention secured to a security-type or law enforcement holster 282. The holster 282 has a rear end wall comprising a rigid spine 284 of the type described in my co-pending application Ser. No. 08/009,852 now abandoned referred to above, spaced inner and outer side walls 285,286 secured at their rear ends in channels provided in the spine for that purpose, and a front end wall 288 which is pivotally secured to the front ends of the side walls via pivot pin 290. The pivoting front end wall structure is substantially the same as described in some embodiments of my co-pending application Ser. No. 07/771,206 now U.S. Pat. No. 5,284,281, referred to above.

Figure 25:
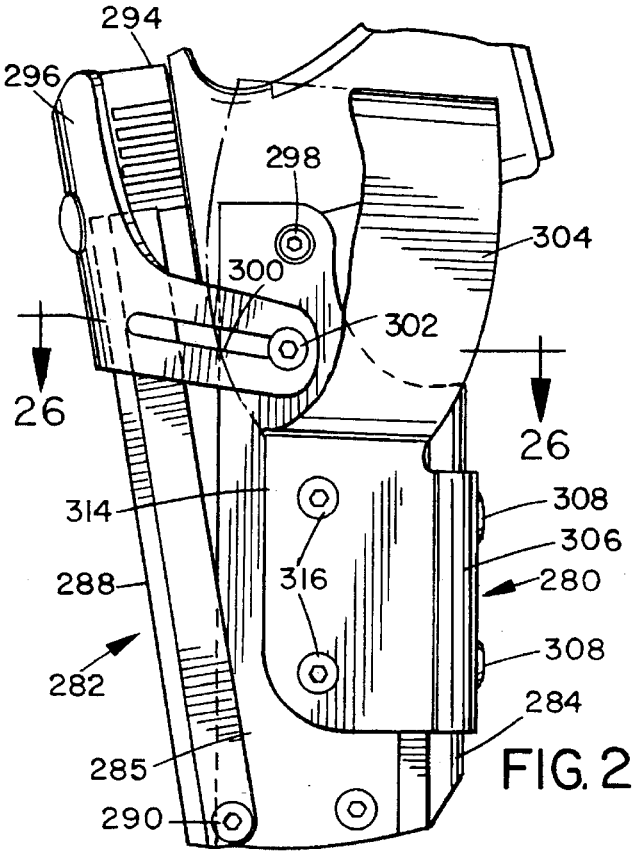
FIG. 25 is a view similar to FIG. 24 illustrating the open position of the holster.

A trigger guard locking device 292 which is identical to that described in application Ser. No. 07/771,206 now U.S. Pat. No. 5,284,281, as described above in connection with FIGS. 1–5, is also secured in the rear spine 284. With this arrangement, a handgun 294 locked in the holster must be pushed down and tilted forwardly in order to release the trigger guard, simultaneously pivoting the front wall 288 forwards to allow the handgun to be drawn from the holster through the resultant opening. As a further level of security, a retaining strap 296 is secured at one end to one side wall of the holster, extends around the front wall, and is releasably secured to the opposite side wall via thumb snap 298. An elongate limit slot 300 is provided in one side of the retaining strap, and a limit pin 302 extends through slot 300 and through an aligned opening in the underlying side wall of the holster. As the front wall of the holster tilts forwardly after thumb snap is released, as illustrated in FIG. 25, pin 302 will travel along the slot 300 until it reaches the opposite end of the slot adjacent the trigger guard position of a holstered handgun, where it prevents any further outward pivoting of the front wall. Thus, the front wall of the holster is not allowed to fall fully open.

Figure 23:
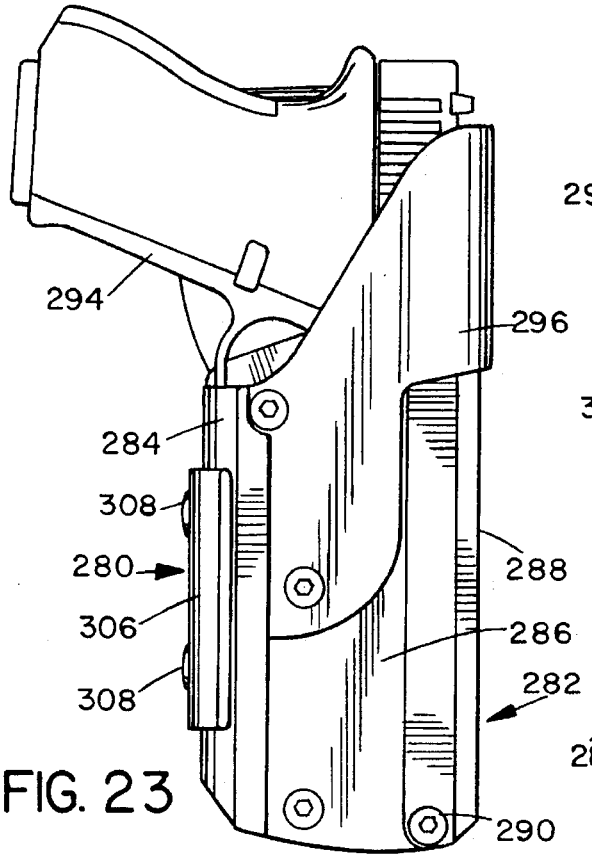
FIG. 23 is a front side elevation view of a holster and hanger device according to another embodiment of the invention.
Figure 24:
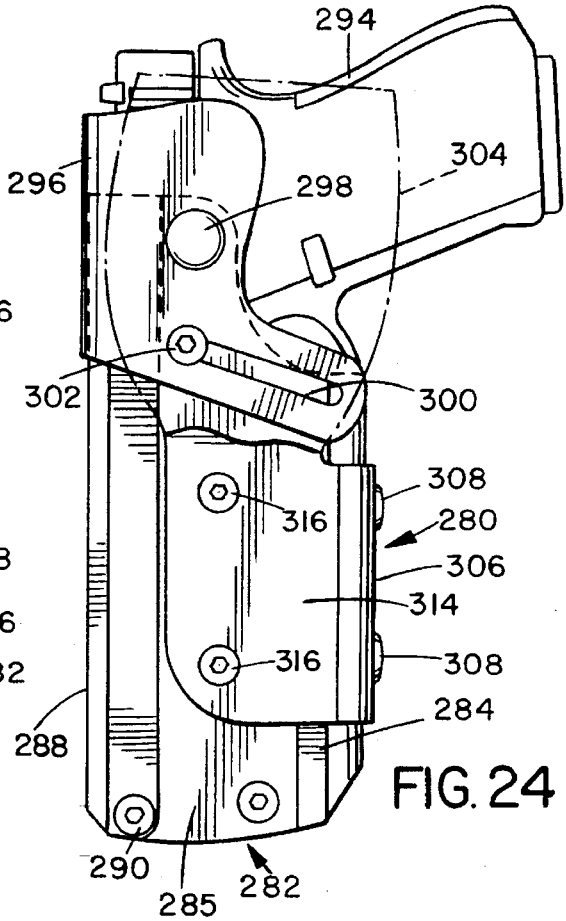
FIG. 24 is a back side elevation view of the holster and hanger device of FIG. 23.

The holster forms a cavity for receiving handgun 294. It will be appreciated from position of the trigger guard locking device in the rear end wall of the holster that the handgun can only be fully seated and secured in the holster in one orientation, i.e. the orientation illustrated in FIGS. 23 and 24, in which the trigger guard of the handgun is facing the rear end wall of the holster and aligned with the locking device. If the handgun were reversed from the position illustrated in FIG. 23, the locking device or block 292 and the upper edge of the front end wall of the holster would prevent full seating of the barrel of the gun into the cavity, as can also be seen from FIG. 26. The holster is of predetermined shape and dimensions so that a handgun 294 of the size illustrated will fit and be secured in the holster cavity in only one orientation, as illustrated in FIGS. 23–25.

Figure 26:
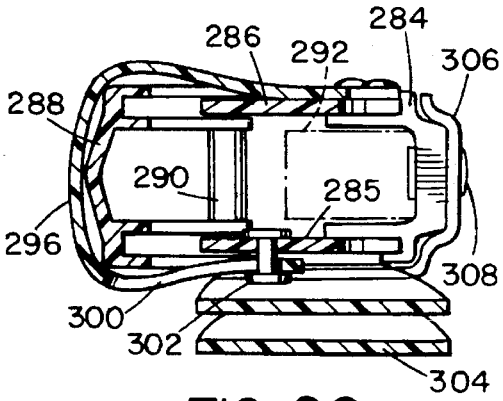
FIG. 26 is a section on the lines 26—26 of FIG. 25.

Hanger device 280 has a first end portion 304 which comprises a belt loop identical to the belt loop 90 illustrated in FIG. 9, and a second end portion 306 which is similar to end portion 28 of the first embodiment illustrated in FIGS. 1–5. Second end portion 306 is secured to the spine 284 via fasteners 308 which may be permanent or releasable, and which extend through aligned holes in the second end portion 306 and spine 284, as illustrated in FIG. 26. The second end portion 306 has a length greater than half the length of the end wall or spine 284 of the holster in a direction parallel to the longitudinal axis of the holster, as best illustrated in FIG. 23. A rigid connecting portion 314 extends between one side of the end portion 306 and the belt loop or first end portion 304. Connecting portion 314 is secured to the inner side wall 285 of the holster via bolts or screw fasteners 316 for added stability and security. Hanger device 280 is formed from a single blank of material which is appropriately shaped and molded to form the first and second end portions. However, the integral belt loop may be replaced with other integral and non-integral arrangements for attaching the hanger device to a belt or waistband, as described in the previous embodiments.

The holster and hanger device of FIGS. 23–26 will be very secure and stable. The hanger device is permanently secured to both the rear end wall and side wall of the holster, making the holster less likely to be detached from a wearer in a struggle, and significantly reducing the risk of fracture and over-flexing of the holster relative to the hanger. The hanger device itself will also add stiffness to the holster side wall and reduce warpage and deformation at that point from repeated handgun drawing forces applied to the holster. The dual attachment points also increase strength and stability by spreading the force over a larger area.

When any of the hanger devices described above are used in a holster which is equipped with a trigger guard locking device, the hanger device can be secured to the end wall nearest the locking device. This focuses the drawing forces at the mounting point of the hanger, where they are most effective and do not tend to deform the holster side walls. Where the holster has a rigid spine structure, a rigid mounting surface is provided whatever materials are used for the holster side walls. The hanger device itself is not dependent on the contours of the holster side walls or the location of any fasteners in the side walls, since it does not have to match the side wall contour in most cases, although it may.

The hanger device may be designed for mounting on either the front or rear end wall of the holster, or even both in some situations. The hanger device attached only to a holster end wall avoids the need to manufacture holsters which are different for right- and left-handed users, since the hanger device does not have to be secured to a specific holster side wall. Instead, right- and left-handed hanger devices can be provided for attachment to the rear or front end wall of the same holster, with the first end portion of the hanger device being on one side of the holster for right-handed users and on the other side of the holster for left-handed users.

The first portion of the hanger device in the embodiments described above is designed for releasably mounting the hanger device on a wearer's belt or waistband. However, it may alternatively be designed for mounting on a shoulder harness for suspending the holster body at or under a wearer's shoulder. The first portion may also be attached relatively permanently to a belt, if desired, by means of rivets, screws, stitching or similar means of attachment.

The connecting portion of the hanger device may have an angle, bend, or offset to tilt the holster away from a wearer's body, as in FIG. 11 above, for example. Where the hanger device includes separate parts which are rotatably secured together, along with offset of the holster as in FIG. 11, a further increase in adjustment range of the twist and offset in the holster position is provided.

The hanger device is suitable for mounting on any type of holster and is stronger and more secure than a conventional side wall hanger. Where the hanger is adjustably mounted only on an end wall of the holster, holster positioning up and down relative to the suspension point on a wearer's body can be adjusted without having to remove the holster from the wearer's body. Tilt adjustment may also be provided at the attachment point.

Although some preferred embodiments of the present invention have been described above by way of example only, it will be understood by those skilled in the field that modifications may be made to the disclosed embodiments without departing from the scope of the present invention, which is defined by the appended claims.

I claim:

1. A holster for receiving a handgun of selected size, comprising:

a holster body having an inner side wall, an outer side wall, a rear end wall and a front end wall forming a cavity for securely seating a handgun in a single, predetermined orientation, the holster cavity being of predetermined shape and dimensions for securely seating a handgun of selected size in said predetermined orientation only in which a rear edge of the handgun including a trigger guard faces said rear end wall, whereby the handgun cannot be securely seated in said cavity in any other orientation;

the rear end wall being substantially rigid and preformed for receiving the trigger guard of a handgun of said selected size inserted into said cavity;

a hanger device having a first end part including means for suspending the hanger device from a person, a second end part spaced from the first end part, and a connecting piece extending between said first and second end parts;

at least the second end part and connecting piece of the hanger device being substantially rigid and the second end part being preformed to conform permanently to the shape of at least part of said rear end wall, said second end part receiving and overlying said part of said rear end wall; and at least one securing device securing the second end part to the rear end wall of the holster.

2. The holster as claimed in claim 1, wherein the second end part of the hanger device terminates short of the outer side wall of the holster.

3. The holster as claimed in claim 1, wherein said holster body has a longitudinal axis defining a direction of insertion of the handgun in said cavity, said rear end wall of said holster has a first length in a direction parallel to said longitudinal axis, and said second end part has a second length in said direction parallel to said longitudinal axis, said second length being greater than half of said first length.

4. The holster as claimed in claim 1, wherein a trigger guard gripping device is mounted in said rear end wall for receiving the trigger guard of a handgun inserted into said cavity.

5. The holster as claimed in claim 1, wherein the overlying portions of said hanger second end part and end wall each have at least one hole aligned with the hole in the other portion, and the securing device extends through said aligned holes.

6. The holster as claimed in claim 5, wherein at least one of said holes comprises an elongate slot, and the securing device comprises at least one releasable fastener device moveable along said slot when released to adjust the position of said holster body relative to said hanger device.

7. The holster as claimed in claim 6, wherein the releasable fastener device comprises a female fastener having a threaded bore and a male fastener for releasable threaded engagement in said bore.

8. The holster as claimed in claim 1, wherein the holster rear end wall comprises a substantially rigid spine member.

9. The holster as claimed in claim 1, wherein the holster has a longitudinal axis defining the direction of insertion of a handgun into the cavity, and the overlying portions of the second end part and holster rear end wall are each substantially flat in a horizontal cross section transverse to the longitudinal axis of the holster.

10. The holster as claimed in claim 1, wherein the engaging portions of the second end part and holster end wall are each of substantially arcuate cross-section.

11. The holster as claimed in claim 1, wherein the engaging portions of the hanger second end part and holster end wall are each of compound-curve cross-section.

12. The holster as claimed in claim 1, wherein the first end part of the hanger device comprises a substantially U-shaped member having a bight and a pair of substantially parallel side walls extending from the bight to form a tunnel for receiving a portion of a belt or garment waistband to suspend the hanger device from the belt or waistband.

13. The holster as claimed in claim 12, wherein the side walls of the U-shaped member have free ends which are secured together to form a belt loop.

14. The holster as claimed in claim 12, wherein one side wall of the U-shaped member comprises a paddle for insertion into a waistband or belt.

15. The holster as claimed in claim 14, wherein said paddle is of larger dimensions than the other side wall of said U-shaped member.

16. The holster as claimed in claim 14, wherein said connecting piece is secured to the other side wall of said U-shaped member.

17. The holster as claimed in claim 14, wherein said connecting piece is secured to said paddle.

18. The holster as claimed in claim 12, wherein the side walls each have an inner face facing into the tunnel and an outer face, and a piece of hook-and-loop fastener material is secured to the inner face of at least one of said tunnel side walls for releasable engagement with a corresponding piece of mating hook-and-loop fastener material on a planar surface of a wearer's waistband or belt.

19. The holster as claimed in claim 1, wherein said connecting piece at least partially overlies the inner side wall of said holster.

20. The holster as claimed in claim 19, including additional securing means securing said connecting piece to the inner side wall of said holster at a location overlying said side wall.

21. The holster as claimed in claim 1, wherein the first and second end parts and connecting piece are formed integrally from a single sheet of material.

22. The holster as claimed in claim 1, wherein the hanger device is formed in at least two separate parts.

23. The holster as claimed in claim 22, wherein the separate parts are pivotally secured together.

24. The holster as claimed in claim 1, wherein the hanger device comprises at least one layer of thermoplastic resin.

25. The holster as claimed in claim 1, wherein the hanger device comprises at least one layer of metal.

26. The holster as claimed in claim 1, wherein the hanger device comprises a one-piece member of substantially rigid material.

27. The holster as claimed in claim 1, wherein said holster has a longitudinal axis defining the direction of insertion of a handgun in said cavity, said second end part of said hanger device is of predetermined length in a direction parallel to said holster longitudinal axis and of predetermined width in a direction transverse to said longitudinal axis for enclosing a predetermined portion of said end wall, and said length is greater than said width.

28. The holster as claimed in claim 27, wherein the holster end wall is of predetermined length in a direction parallel to said longitudinal axis, and the length of the second end part of the hanger device is at least half of the length of the holster end wall.

29. A holster for receiving a handgun of selected size, comprising:

a holster body having an inner side wall, an outer side wall, a rear end wall and a front end wall forming a cavity for securely and fully seating a handgun in one orientation only in said cavity, the holster cavity being of predetermined shape and dimensions for securely and fully seating a handgun of selected size in said one orientation only;

the rear end wall being substantially rigid and preformed;

the front end wall having means for receiving at least a front sight of a handgun inserted into said cavity in said one orientation a hanger device having a first end part including means for suspending the hanger device from a person, a second end part spaced from the first end part, and a connecting piece extending between said first and second end parts;

at least the second end part and connecting piece of the hanger device being substantially rigid and the second end part being preformed to conform permanently to the shape of at least part of said rear end wall, said second end part receiving and overlying said part of said rear end wall; and at least one securing device securing the second end part to the rear end wall of the holster.

* * * * *